US009278366B2

(12) United States Patent
Käske

(10) Patent No.: US 9,278,366 B2
(45) Date of Patent: Mar. 8, 2016

(54) METHOD FOR SUPPLYING A CLEANING MEDIUM AND METHOD AND CLEANING DEVICE FOR CLEANING A WORKPIECE

(75) Inventor: Egon Käske, Aachen (DE)

(73) Assignee: Dürr Ecoclean GmbH, Filderstadt (DE)

( * ) Notice: Subject to any disclaimer, the term of this patent is extended or adjusted under 35 U.S.C. 154(b) by 670 days.

(21) Appl. No.: 12/552,789

(22) Filed: Sep. 2, 2009

(65) Prior Publication Data

US 2010/0043841 A1 Feb. 25, 2010

Related U.S. Application Data

(63) Continuation of application No. PCT/EP2008/002581, filed on Apr. 1, 2008.

(30) Foreign Application Priority Data

Apr. 4, 2007 (DE) ..... 10 2007 016 246

(51) Int. Cl.

| | |
|---|---|
| ***B08B 3/02*** | (2006.01) |
| ***B08B 5/02*** | (2006.01) |
| ***B05B 7/26*** | (2006.01) |
| ***B08B 3/00*** | (2006.01) |

(52) U.S. Cl.
CPC . *B05B 7/267* (2013.01); *B08B 3/00* (2013.01); *B08B 3/02* (2013.01)

(58) Field of Classification Search
CPC ..... B05B 7/267; B08B 3/02
USPC ..... 134/36, 102.1, 902, 26; 239/8
See application file for complete search history.

(56) References Cited

U.S. PATENT DOCUMENTS

| | | | | |
|---|---|---|---|---|
| 2,594,833 | A * | 4/1952 | White | 417/38 |
| 2,621,596 | A * | 12/1952 | Jacuzzi | 137/211.5 |
| 2,709,964 | A * | 6/1955 | Brady, Jr. | 417/3 |
| 5,385,168 | A * | 1/1995 | Lund | 137/337 |
| 5,868,280 | A * | 2/1999 | Schroeder | 222/64 |

FOREIGN PATENT DOCUMENTS

| | | |
|---|---|---|
| DE | 19611663 | 10/1997 |
| EP | 1514606 | 3/2005 |
| WO | 99/34422 | 7/1999 |
| WO | 9934422 | 7/1999 |

OTHER PUBLICATIONS

International Searching Authority, International Search Report for PCT/EP2008/002581, mailed Aug. 6, 2008, 4 pages.
German Patent Office, "Search Report," dated Aug. 21, 2009, 4 pages.
Patent Cooperation Treaty, "International Preliminary Report on Patentability," issued in connection with PCT Application No. PCT/EP2008/002581, issued on Oct. 6, 2009, 6 pages.
Patent Cooperation Treaty, "Written Opinion of the International Searching Authority," issued in connection with PCT Application No. PCT/EP2008/002581, issued on Oct. 4, 2009, 9 pages.

* cited by examiner

*Primary Examiner* — Douglas Lee
(74) *Attorney, Agent, or Firm* — Hanley, Flight & Zimmerman, LLC

(57) ABSTRACT

In order to improve the efficiency of a method for supplying a cleaning medium, it is suggested that a cleaning gas, in particular, air be introduced into a reservoir (6) and that a cleaning liquid (38) subject to pressure be introduced into the reservoir for acting on the cleaning gas with pressure, said cleaning gas being subject to an initial pressure. Furthermore, a method for cleaning a workpiece and a cleaning device are suggested.

13 Claims, 4 Drawing Sheets

METHOD FOR SUPPLYING A CLEANING MEDIUM AND METHOD AND CLEANING DEVICE FOR CLEANING A WORKPIECE

This application is a continuation of international application number PCT/EP2008/002581 filed on Apr. 1, 2008.

The present disclosure relates to the subject matter disclosed in international application number PCT/EP2008/002581 of Apr. 1, 2008 and German application number 10 2007 016 246.6 of Apr. 4, 2007, which are incorporated herein by reference in their entirety and for all purposes.

BACKGROUND OF THE INVENTION

The present invention relates to a method for supplying a cleaning medium.

In order to liberate workpieces from impurities, it is known to conduct a stream of compressed air onto a dirty workpiece and to blow the impurities off the workpiece with the aid of the stream of compressed air.

A further possibility for cleaning workpieces is for a cleaning liquid to be subjected to pressure and sprayed onto the workpiece in order to spray or wash the impurities off the workpiece.

It may be desirable for many applications to clean workpieces with the aid of compressed air and with the aid of a cleaning liquid. This does, however, entail relatively large resources with respect to technical equipment since not only a system for supplying the compressed air but also a system for supplying the cleaning liquid are required.

Proceeding on this basis, the object underlying the present invention is to create a method for supplying a cleaning medium, the efficiency of which is improved in comparison with known methods.

SUMMARY OF THE INVENTION

This object is accomplished in the case of a method for supplying a cleaning medium in that a cleaning gas, in particular, air is introduced into a reservoir and that a cleaning liquid subject to pressure is introduced into the reservoir in order to act on the cleaning gas with pressure, this cleaning gas being subject to an initial pressure.

The method according to the invention makes it possible to supply a cleaning medium which comprises a cleaning gas and a cleaning liquid. Since the cleaning liquid is subject to pressure, the cleaning gas which is subject to an initial pressure can be acted upon with pressure with the aid of the cleaning liquid. This has the advantage that for the purpose of acting on the cleaning gas with pressure no further devices, in particular, compressors are required. As a result, the supply of a cleaning medium, which comprises a cleaning gas subject to a high pressure, is simplified.

According to one embodiment of the invention, the cleaning gas and the cleaning liquid are introduced into the reservoir one after the other. This has the advantage that the partial volumes which are occupied by the cleaning gas and the cleaning liquid in the reservoir can be coordinated with one another particularly well.

Preferably, the cleaning gas is introduced into the reservoir first of all and then the cleaning liquid. As a result, the amount of cleaning gas introduced into the reservoir may be adjusted particularly exactly.

According to a further embodiment of the invention, the cleaning gas and the cleaning liquid can be introduced into the reservoir at the same time. This has the advantage that the period of time required, altogether, to supply the cleaning medium can be reduced. Furthermore, it is possible to introduce cleaning gas into the reservoir first of all, then introduce cleaning gas and cleaning liquid into the reservoir at the same time for a certain length of time and, subsequently, introduce only cleaning liquid into the reservoir.

The cleaning gas and the cleaning liquid are preferably brought into direct contact with one another in the reservoir. This has the advantage that the reservoir can be constructed in a very simple manner without any separating element between the cleaning gas and the cleaning liquid. For example, the reservoir can be designed in the form of a storage tank which provides a common storage volume for the cleaning gas and the cleaning liquid.

According to one embodiment of the invention, the cleaning gas is subject to an initial pressure, which is equal to ambient pressure, prior to the cleaning liquid acting on it with pressure. This has the advantage that the cleaning gas can also be introduced into the reservoir without any additional aids, for example, in that a connection is created between the storage volume of the reservoir and the surroundings of the reservoir. In the simplest case, it may, therefore, be sufficient to connect the storage volume to the surroundings of the reservoir in order to make it possible for air subject to ambient pressure to be introduced into the reservoir and be acted upon with pressure with the aid of the cleaning liquid.

It may be advantageous for the cleaning gas to be subject to an initial pressure of at least approximately 1 bar prior to the cleaning liquid acting on it with pressure. This has the advantage that the cleaning gas, in particular, air can be taken directly from the surroundings of the reservoir and introduced into the reservoir.

It may be advantageous for the cleaning gas to be subject to an initial pressure of at least approximately 2 bar prior to the cleaning liquid acting on it with pressure. The increase in the initial pressure of the cleaning gas has the advantage that with a predetermined storage volume a greater volume proportion is available for the cleaning gas than in the case of lower initial pressures.

It is advantageous when the cleaning gas is subject to an initial pressure of at the most approximately 10 bar prior to the cleaning liquid acting on it with pressure. As a result, the cleaning gas can be brought to an initial pressure which is higher than ambient pressure with the aid of simple compressors without the use of expensive compressors being necessary.

The cleaning gas is supplied in an advantageous manner by means of a supply device for cleaning gas which acts on the cleaning gas with a supply pressure for cleaning gas. This supply pressure for cleaning gas can correspond in the simplest case to the ambient pressure. It is, however, advantageous when the supply device for cleaning gas makes a compression of the cleaning gas possible, for example, in order to act on it, proceeding from an ambient pressure of, for example, approximately 1 bar, with an increased supply pressure for cleaning gas of, for example, at least approximately 2 bar up to, for example, approximately 10 bar. This makes it possible to introduce a greater amount of cleaning gas into a predetermined storage volume.

The introduction of the cleaning gas into the reservoir is, in an advantageous manner, controlled by means of a blocking device. As a result, the amount of cleaning gas to be introduced into the reservoir can be adjusted particularly well.

According to one embodiment of the invention, the cleaning gas is supplied by means of a supply device for cleaning gas which acts on the cleaning gas with a supply pressure for cleaning gas and the blocking device is opened proceeding from a closed state until the cleaning gas introduced into the reservoir as a result is subject to an initial pressure which is equal to the supply pressure for cleaning gas and the blocking device is subsequently closed. The blocking device can, therefore, be opened for such a time until the cleaning gas which has been introduced into the reservoir is subject to the same pressure as that, at which the supply device for cleaning gas supplies cleaning gas subject to the supply pressure for cleaning gas. As a result, the initial pressure of the cleaning gas, i.e., the pressure of the cleaning gas in the reservoir prior to the cleaning liquid acting on it with pressure can be adjusted exactly to the value of the supply pressure for cleaning gas.

According to a further embodiment of the invention, the cleaning gas is supplied by means of a supply device for cleaning gas which acts on the cleaning gas with a supply pressure for cleaning gas and the blocking device is opened proceeding from a closed state only for such a time that the cleaning gas introduced into the reservoir as a result is subject to an initial pressure which is lower than the supply pressure for cleaning gas and the blocking device is then closed. As a result, it is possible to introduce the cleaning gas into the reservoir in a particularly short time.

It is advantageous when the cleaning liquid is brought to an operating pressure which exceeds the initial pressure of the cleaning gas prior to being introduced into the reservoir. As a result, the cleaning liquid can be acted upon with pressure outside the reservoir.

The cleaning liquid will preferably be brought to an operating pressure of at least approximately 2 bar prior to being introduced into the reservoir. As a result, cleaning gas subject, for example, to an initial pressure of 1 bar can be acted upon with double the pressure.

In particular, the cleaning liquid will be brought to an operating pressure of at least approximately 5 bar prior to being introduced into the reservoir. As a result, the cleaning gas can be acted upon with a corresponding pressure and so it can be supplied with a pressure which makes a good cleaning action possible.

The cleaning liquid will preferably be brought to an operating pressure of at the most approximately 80 bar prior to being introduced into the reservoir. These pressures can be provided with the aid of comparatively simple pumps.

The cleaning liquid will, in particular, be brought to an operating pressure of at the most approximately 40 bar prior to being introduced into the reservoir. As a result, pumps which are of an even less complicated construction can be used.

It may be provided for the cleaning liquid to be supplied by means of a supply device for cleaning liquid which acts on the cleaning liquid with a supply pressure for cleaning liquid. This makes a simple control of the operating pressure, with which the cleaning liquid acts on the cleaning gas with pressure, possible.

The introduction of cleaning liquid into the reservoir is preferably controlled by means of a shut-off device. This makes an exact adjustment of the amount of cleaning liquid, which is introduced into the reservoir, possible.

According to one embodiment of the invention, the cleaning liquid is supplied by means of a supply device for cleaning liquid which acts on the cleaning liquid with a supply pressure for cleaning liquid and the shut-off device is opened proceeding from a closed state until the cleaning liquid introduced into the reservoir as a result acts on the cleaning gas with the supply pressure for cleaning liquid and the shut-off device is subsequently closed. In this case, the cleaning liquid can be introduced into the reservoir until the operating pressure, with which the cleaning liquid acts on the cleaning gas, corresponds to the supply pressure for cleaning liquid. This makes a simple adjustment of the operating pressure, with which the cleaning liquid acts on the cleaning gas, possible.

According to a further embodiment of the invention, the cleaning liquid is supplied by means of a supply device for cleaning liquid which acts on the cleaning liquid with a supply pressure for cleaning liquid and the shut-off device is opened proceeding from a closed state only for such a time that the cleaning liquid introduced into the reservoir as a result acts on the cleaning gas with an operating pressure which is lower than the supply pressure of the cleaning liquid and the shut-off device is then closed. This makes a particularly rapid introduction of the cleaning liquid into the reservoir possible, which results in the cleaning gas being acted upon with pressure in a particularly fast manner.

In addition, it may be advantageous for the cleaning liquid to be filtered by means of a filtering device. As a result, it is possible to prevent solids from being deposited in the reservoir.

It is favorable when the cleaning liquid is taken from a storage tank. As a result, the cleaning liquid can be supplied in sufficiently large quantities even during a multiple running of the method according to the invention.

It may be advantageous for cleaning liquid subject to the supply pressure for cleaning liquid to be returned to the storage tank. As a result, it is possible for the cleaning liquid to be kept available at the supply pressure for cleaning liquid even when the cleaning liquid is not being used and to then be available without any delay in time when it is needed, i.e., when the cleaning liquid is introduced into the reservoir.

The present invention relates, in addition, to a method for cleaning a workpiece which comprises the supply of a cleaning medium by way of a method for supplying a cleaning medium as described above as well as the delivery of the cleaning gas from the reservoir to the workpiece.

The method according to the invention for cleaning a workpiece is suitable, in particular, for machined workpieces. These may have machining residues, such as, for example, metal chips, abrasives, molding sand and machining fluids which can be removed from the workpiece with the aid of the cleaning gas. The method according to the invention is particularly well suited for removing residues from cavities in engine parts, in particular, in cylinder heads.

Strong turbulences occur on and in the workpiece as a result of a high velocity of the cleaning gas on account of an increased operating pressure of the cleaning gas and this causes a good dirt dislodging action.

The cleaning method according to the invention can take place directly in a machining station, in which the workpiece to be cleaned has been machined or is intended to be machined.

It is particularly advantageous when the method for cleaning a workpiece comprises the delivery of the cleaning liquid from the reservoir to the workpiece. This makes it possible for the workpiece to be cleaned not only with the aid of cleaning gas but also with the aid of cleaning liquid. As a result, a particularly good cleaning action can be achieved. For this purpose, it is not necessary, in contrast to the state of the art, to provide systems for cleaning gas and for cleaning liquid which are separate from one another. On the contrary, both cleaning gas and cleaning liquid can be taken from a common reservoir. As a result, a combined use of cleaning gas and cleaning liquid on the same workpiece is made possible with technical equipment resources which are very small.

The cleaning gas and the cleaning liquid are preferably conveyed from the reservoir to the workpiece one after the other. As a result, it is possible to avoid any possibly undesired mixing of the cleaning gas with the cleaning liquid and any premature reduction in the operating pressure of the cleaning gas.

The cleaning gas is preferably conveyed from the reservoir to the workpiece first of all and then the cleaning liquid. This has the advantage that impurities are dislodged from the workpiece first of all with the aid of the cleaning gas and then the impurities dislodged from the workpiece can be washed or sprayed off with the aid of the cleaning liquid. As a result, a particularly good cleaning effect can be achieved.

The delivery of cleaning gas and/or cleaning liquid from the reservoir to the workpiece is preferably controlled by means of a flow control unit. This makes a simple adjustment of the volume flow of the cleaning gas and/or of the cleaning liquid possible.

It can be advantageous to open the flow control unit suddenly, proceeding from a closed state, for the purpose of delivering the cleaning gas from the reservoir to the workpiece. It is advantageous, in particular, when the transition from the closed into the open state, preferably into the completely open state, takes place within a period of time of at the most approximately 2 seconds, preferably at the most approximately 0.5 seconds. As a result, the cleaning gas which is subject to pressure can be delivered to the workpiece with a high flow velocity.

According to one embodiment of the invention, the cleaning gas and/or the cleaning liquid can be delivered to the workpiece with a volume flow which is at least approximately constant with respect to time. As a result, a particularly uniform cleaning action can be achieved.

According to one embodiment of the invention, the cleaning gas and/or the cleaning liquid can be delivered to the workpiece with a pulsating volume flow.

In this respect, the amount of cleaning gas delivered and/or of cleaning liquid delivered varies between different volume flow values. This variation can be brought about with a predetermined frequency. The pulsating volume flow can, where applicable, increase the cleaning action further.

Cleaning liquid subject to pressure is preferably introduced into the reservoir during the delivery of cleaning gas and/or cleaning liquid from the reservoir to the workpiece. This has the advantage that the pressure, with which the cleaning gas and/or the cleaning liquid is acted upon in the reservoir, can be maintained. As a result, a constant cleaning action is ensured.

A further embodiment of the invention provides for the cleaning gas to be expelled completely or essentially completely from the reservoir prior to or during the delivery of cleaning liquid to the workpiece. As a result, the use of the entire amount of cleaning gas available in the reservoir is made possible.

The invention relates, in addition, to a cleaning device for cleaning a workpiece, with a reservoir for storing a cleaning medium and with a delivery device for the delivery of the cleaning medium from the reservoir to the workpiece.

The additional object underlying the invention is to create a cleaning device, with which an efficient supply of a cleaning medium is made possible. This object is accomplished in accordance with the invention, in a cleaning device with the features of the preamble to claim 37, in that the reservoir is connected to a supply device for cleaning gas for introducing a cleaning gas, in particular, air into the reservoir and that for the purpose of acting on the cleaning gas with pressure the reservoir is connected to a supply device for cleaning liquid for introducing cleaning liquid subject to pressure into the reservoir.

Special configurations of the cleaning device according to the invention are the subject matter of dependent claims 38 to 61, the advantages of which have, in part, already been explained above in conjunction with the special configurations of the method according to the invention. Therefore, details will be given in the following only for those configurations of the cleaning device according to the invention, the advantages of which have not already been explained above.

It may be advantageous for the supply device for cleaning gas to comprise a venting device which communicates with the surroundings of the cleaning device. This has the advantage that the supply device for cleaning gas can be vented at least in sections and brought to the pressure of the surroundings of the cleaning device. This can be advantageous, for example, for maintenance purposes.

The supply device for cleaning gas comprises in an advantageous manner a feed line for cleaning gas for connecting the supply device for cleaning gas to the reservoir. This makes it possible to deliver cleaning gas from a source of cleaning gas, which is spatially remote, to the reservoir.

The feed line for cleaning gas opens in an advantageous manner at or in an upper area in the normal position of the reservoir. This has the advantage that the cleaning gas can be conveyed directly to an upper area of the reservoir. As a result, any, where applicable, undesired intermixing with the cleaning liquid can be avoided. This intermixing can be avoided, in particular, when the feed line for cleaning gas opens at or in an uppermost area of the reservoir in the normal position of the reservoir.

The supply device for cleaning liquid preferably comprises a device for applying pressure for acting on the cleaning liquid with pressure. This has the advantage that the cleaning liquid can be conveyed into the reservoir and also be acted upon with pressure with the aid of the supply device for cleaning liquid.

It is particularly advantageous when the device for applying pressure comprises a pump. This can be configured and activated accordingly for desired quantities and desired supply pressures for cleaning liquid.

It may be advantageous when the supply device for cleaning liquid comprises a switch-over unit which feeds the cleaning liquid optionally to the reservoir or to the storage tank. This has the advantage that a pump provided where applicable can be in continuous operation. When not in use, the cleaning liquid can be conveyed to the storage tank. When required, the cleaning liquid which is subject to the supply pressure for cleaning liquid is available to be introduced into the reservoir without any delay in time.

The cleaning device comprises in an advantageous manner an outlet unit which can take up a closed position and an open position, in which the outlet unit drains cleaning liquid and/or cleaning gas from the reservoir. The outlet unit has the advantage that the reservoir can be emptied without the delivery device of the cleaning device having to be used for this purpose.

The outlet unit preferably comprises an outlet line. This makes it possible to conduct cleaning gas and/or cleaning liquid away from the reservoir.

The outlet line is preferably fed from a lower area of the reservoir in a normal position so that as large an amount of cleaning gas and/or cleaning liquid as possible can be drained off.

The outlet line is preferably fed from a lowermost area of the reservoir in a normal position so that the reservoir can be emptied completely.

It is particularly advantageous when the outlet line opens at or in the storage tank of the supply device for cleaning liquid. As a result, cleaning liquid introduced into the reservoir can be delivered to the storage tank again and from there be introduced into the reservoir again.

It may be advantageous for the delivery device to comprise a device for generating a pulsating volume flow of cleaning gas and/or cleaning liquid. Such a device is described in WO 03/036144 A1 and reference is made herewith to its disclosure.

The delivery device preferably comprises an output unit which discharges the cleaning gas and/or the cleaning liquid in the direction towards the workpiece. The output unit makes it possible to influence the local distribution, with which the cleaning gas and/or the cleaning liquid is conveyed onto the workpiece or introduced into the workpiece.

The output unit preferably comprises at least one nozzle unit so that the cleaning medium can be discharged onto the workpiece in a finely distributed manner.

The present invention relates, in addition, to the use of a cleaning device as defined in any one of claims 37 to 61 for carrying out a method as defined in any one of claims 1 to 36.

Additional features and advantages of the invention are the subject matter of the following description and the drawings illustrating one embodiment.

DETAILED DESCRIPTION OF THE INVENTION

Figure 1:
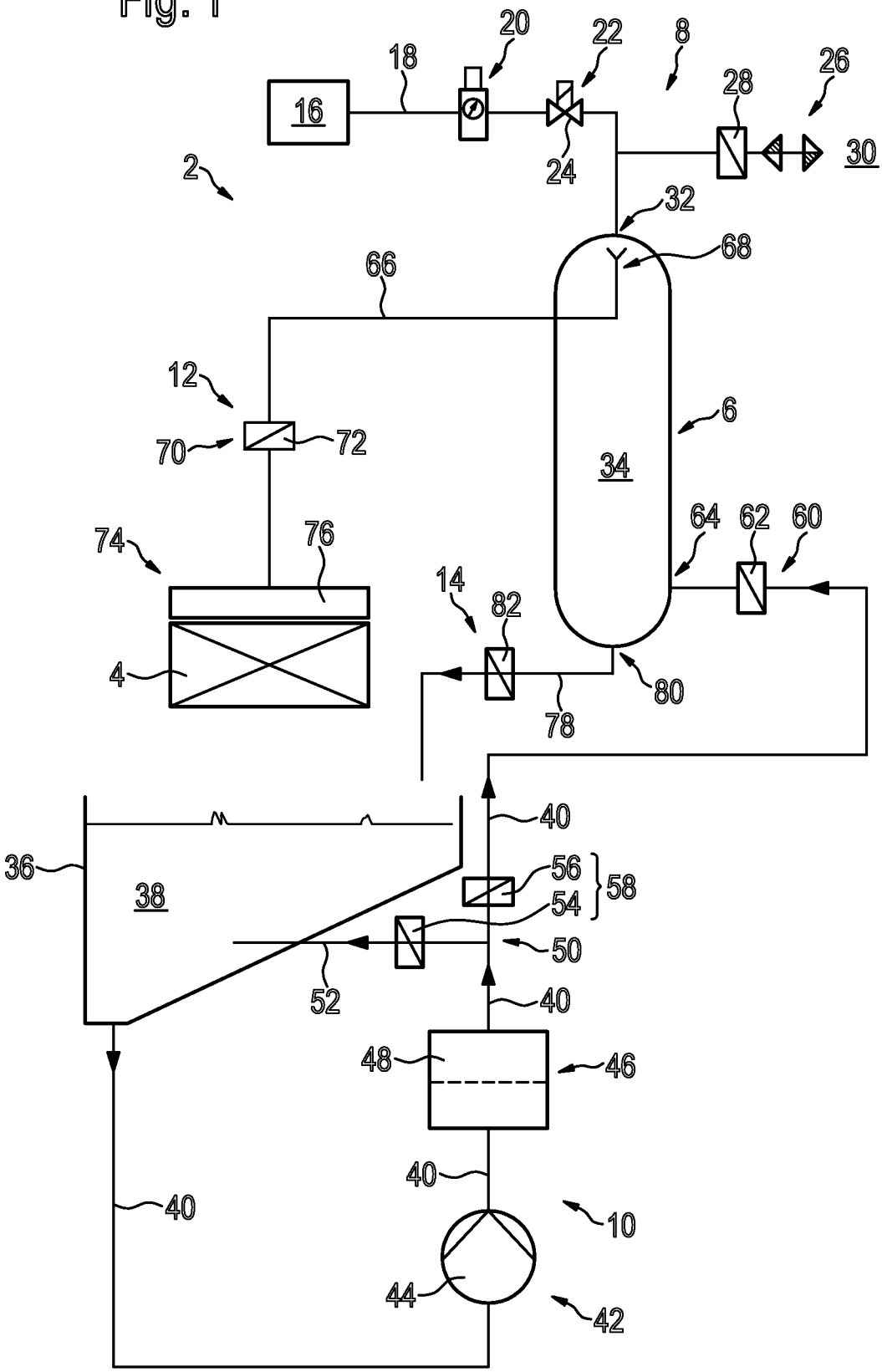
FIG. 1 shows a schematic illustration of a cleaning device for cleaning a workpiece, wherein the cleaning device comprises a reservoir which is filled with a cleaning gas in a first phase of a cleaning process.

A cleaning device, which is illustrated in FIGS. 1 to 4 and designated as a whole as 2, serves the purpose of cleaning a workpiece 4, for example, a cylinder head or a crankcase. The cleaning device 2 comprises a reservoir 6, into which cleaning gas can be introduced with the aid of a supply device 8 for cleaning gas. The cleaning device comprises, in addition, a supply device 10 for cleaning liquid, by means of which cleaning liquid can be introduced into the reservoir 6. The cleaning device 2 comprises, in addition, a delivery device 12 for the delivery of cleaning gas and/or cleaning liquid from the reservoir 6 to the workpiece 4.

The supply device 8 for cleaning gas comprises a compressor 16 which compresses cleaning gas, in particular, air and acts on it with a supply pressure for cleaning gas. The supply device 8 for cleaning gas comprises, in addition, a feed line 18 for cleaning gas which conveys the cleaning gas from the compressor 16 to the reservoir 6. The supply device 8 for cleaning gas comprises, in addition, a pressure measuring device 20, with which the supply pressure for cleaning gas can be ascertained. The pressure measuring device 20 is arranged downstream of the compressor 16 when seen in the direction of flow of the cleaning gas. A blocking device 22 is provided downstream of the pressure measuring device 20 and this is designed as a check valve 24. A venting device 26 is provided downstream of the blocking device 22 and this comprises a vent valve 28, via which the feed line 18 for cleaning gas can communicate with the surroundings 30 of the cleaning device 2. The feed line 18 for cleaning gas opens at an uppermost area 32 of the reservoir 6 which contains a storage volume 34.

The supply device 10 for cleaning liquid comprises a storage tank 36 for storing cleaning liquid 38. The storage tank 36 feeds a feed line 40 for cleaning liquid, via which the cleaning liquid can be delivered from the storage tank 36 to a device 42 for applying pressure. The device 42 for applying pressure is designed in the form of a pump 44. The pump 44 has not only a conveying function for the purpose of conveying cleaning liquid 38 from the storage tank 36 to the reservoir 6 but also a function of applying pressure for the purpose of acting on the cleaning liquid 38 with a supply pressure for cleaning liquid.

The cleaning liquid 38 is conveyed via the feed line 40 for cleaning liquid from the pump 44 to a filtering device 46 which is designed as a filter 48. A return line 52 branches off downstream of the filter 48 at a junction 50 and opens into the storage tank 36. The return line 52 can be opened or blocked with the aid of a first switch-over valve 54.

A second switch-over valve 56 is provided, in addition, downstream of the junction 50. The first switch-over valve 54 and the second switch-over valve 56 together form a switch-over device 58. The feed line 40 for cleaning liquid leads to a shut-off device 60 downstream of the second switch-over valve 56. This shut-off device is designed in the form of a shut-off valve 62. The feed line 40 for cleaning liquid opens at a lower area 64 of the reservoir 6 downstream of the shut-off valve 62.

The delivery device 12 comprises a delivery line 66 which is fed from an upper area 68 of the reservoir 6. The delivery device 12 comprises, in addition, a flow control unit 70 which is designed as a flow control valve 72. The delivery line 66 opens at an output device 74 which comprises a nozzle unit 76.

Cleaning gas and/or cleaning liquid 38 can be discharged in the direction towards the workpiece 4 with the nozzle unit 76.

The outlet device 14 comprises an outlet line 78 which is fed from a lowermost area 80 of the reservoir 6. The outlet device 14 comprises, in addition, a valve 82 so that the outlet device 14 can take up a closed position and an open position, in which the outlet device 14 can drain cleaning liquid 38 and/or cleaning gas from the reservoir 6. The outlet line 78 opens at or in the storage tank 36.

In the state of the cleaning device 2 illustrated in FIG. 1, the check valve 24 of the supply device 8 for cleaning gas is closed and so cleaning gas cannot pass into the reservoir 6. The venting valve 28 of the venting device 26 is open and so the supply device 8 for cleaning gas downstream of the check valve 24 and the reservoir 6 are without pressure.

The first switch-over valve 54 of the supply device 10 for cleaning liquid is open whereas the second switch-over valve 56 is closed. As a result, the pump 44 can draw in cleaning liquid 38 from the storage tank 36 and act on it with a supply pressure for cleaning liquid. The cleaning liquid subject to pressure is filtered with the aid of the filter 48 and conveyed back into the storage tank 36 again via the return line 52 so that a circular flow is formed for the cleaning liquid through the filtering device 46.

The shut-off valve 62 of the supply device 10 for cleaning liquid and the flow control valve 72 of the delivery device 12 are closed. The valve 82 of the outlet device 14 is open. The reservoir 6 is completely emptied.

Proceeding from the state of the cleaning device 2 described with reference to FIG. 1, the reservoir 6 can be filled with a cleaning medium. This will be described in the following with reference to FIG. 2.

In order to introduce a cleaning gas 84 into the reservoir 6, the valve 82 of the outlet device 14 is, first of all, closed. Subsequently, the venting valve 28 of the supply device 8 for cleaning gas is closed and the check valve 24 opened. As a result, cleaning gas 84 flows into the reservoir 6 from the compressor 16 via the feed line 18 for cleaning gas. The cleaning gas 84 is then subject to an initial pressure in the reservoir 6.

The cleaning gas 84 can also be subject to an initial pressure in the reservoir 6 which corresponds to the pressure in the surroundings 30. In this case, it is not necessary to compress the cleaning gas 84 with the aid of the compressor 16.

Once the cleaning gas 84 has been introduced into the reservoir 6, the check valve 24 will be closed. Subsequently, the switch-over device 58 of the supply device 10 for cleaning liquid is activated such that the first switch-over valve 54 is closed and the second switch-over valve 56 opened. This has the effect that the pump 44 no longer conveys cleaning liquid 38 via the return line 52 into the storage tank 36 but rather via the feed line 40 for cleaning liquid to the shut-off valve 62. When this is opened proceeding from its closed state, the cleaning liquid flows into the reservoir 6 so that the cleaning gas 84 already contained in the reservoir 6 is acted upon with pressure with the aid of the cleaning liquid 38, proceeding from its initial pressure. The pressure, with which the cleaning liquid 38 acts on the cleaning gas 84, is designated in the following as operating pressure.

The reservoir 6 is tightly closed in this phase except for the shut-off valve 62.

When the shut-off valve 62 remains open long enough, the cleaning liquid 38 can be introduced into the reservoir 6 for such a time until the cleaning liquid 38 and the cleaning gas 84 in the reservoir 6 are subject to a pressure which corresponds to the supply pressure for cleaning liquid which is predetermined by the pump 44. In this state, the cleaning liquid 38 acts on the cleaning gas 84 with an operating pressure which is equal to the supply pressure for cleaning liquid.

Figure 2:
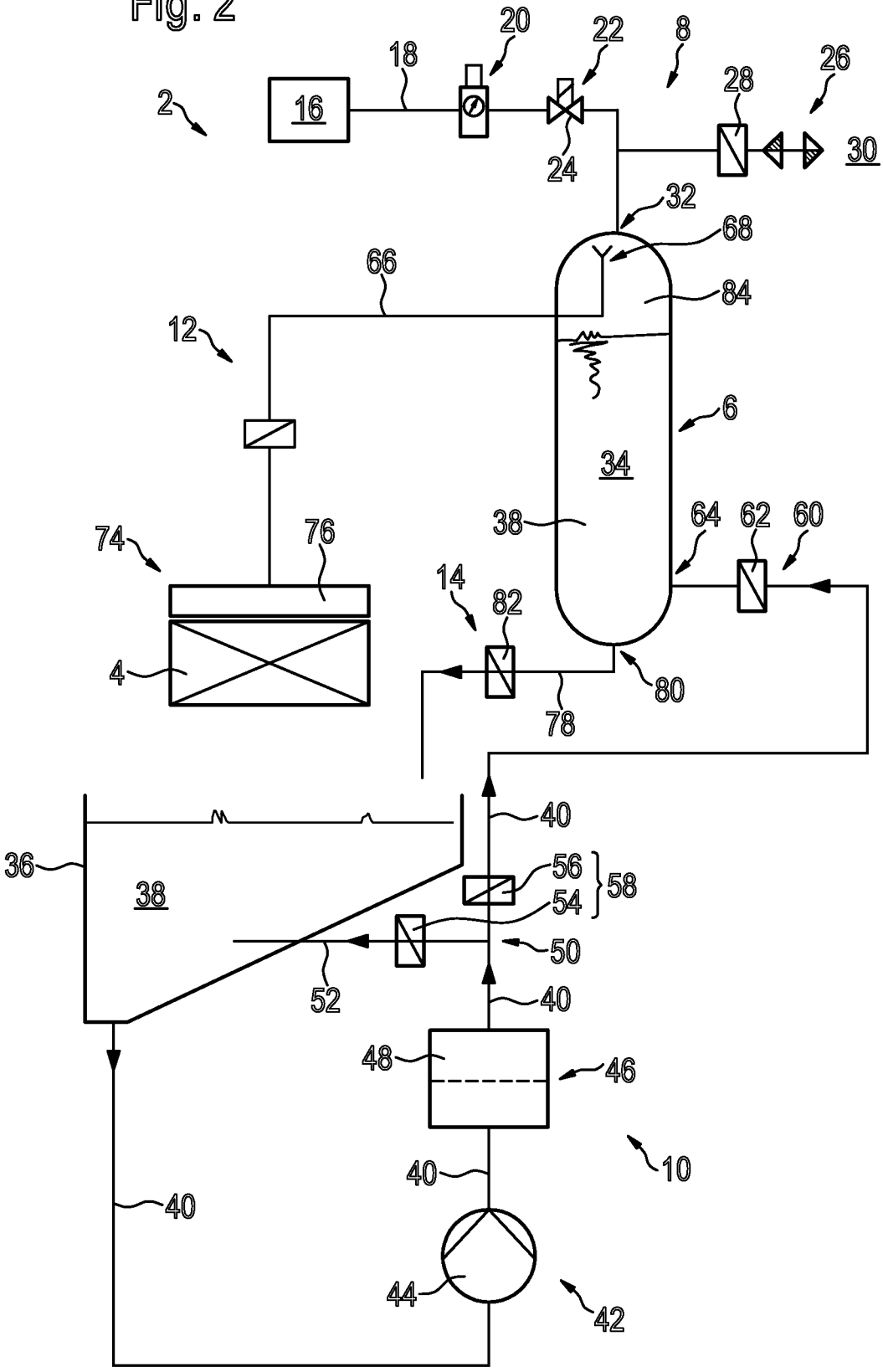
FIG. 2 shows the cleaning device according to FIG. 1 in a second phase of the cleaning process, in which cleaning liquid is introduced into the reservoir.
Figure 3:
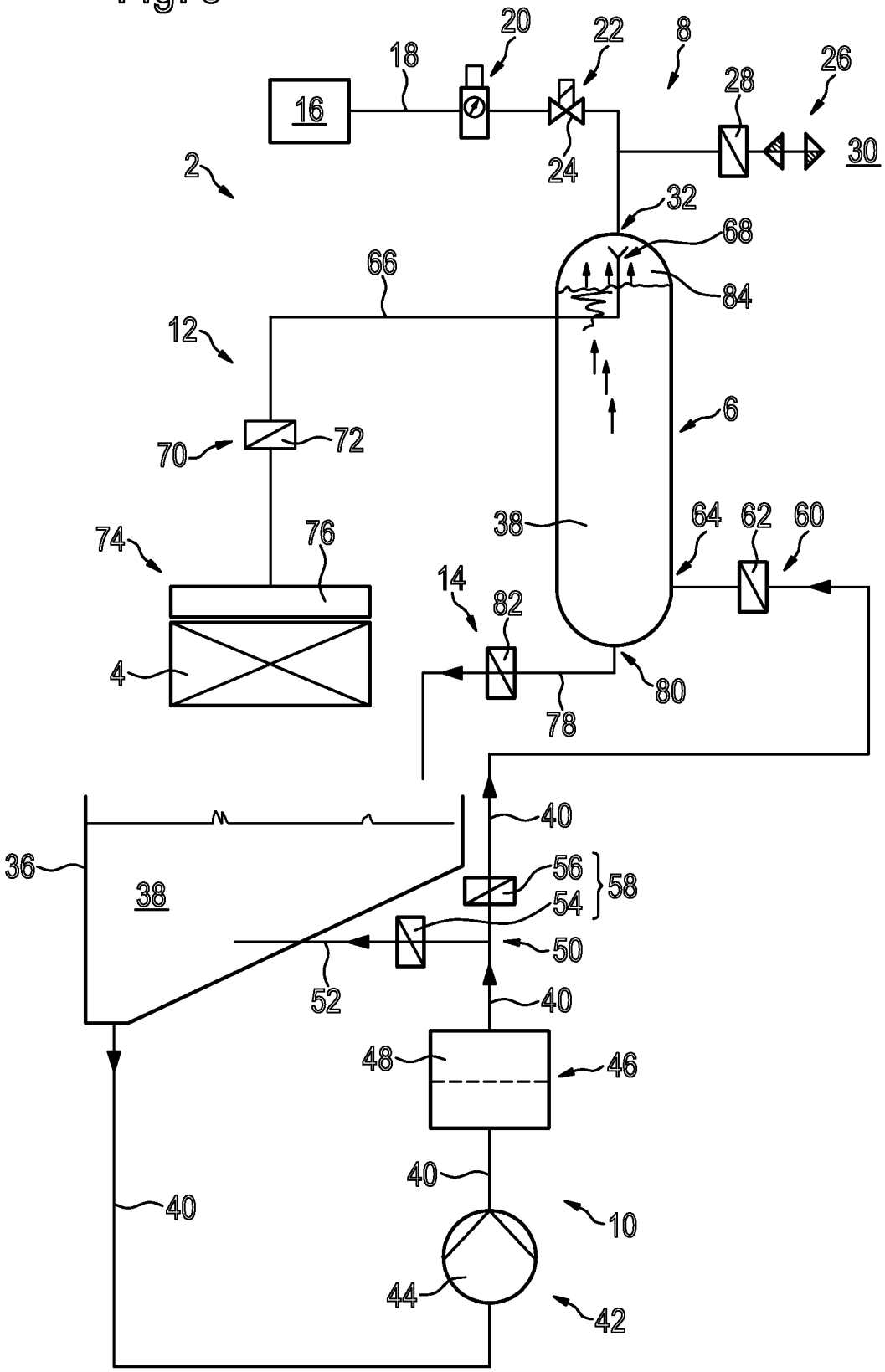
FIG. 3 shows the cleaning device according to FIG. 1 in a third phase of the cleaning process, in which cleaning gas is delivered from the reservoir to a workpiece.

Proceeding from the state of the cleaning device 2 described with reference to FIG. 2, the flow control valve 72 will now be opened, preferably suddenly, i.e., in as short a time as possible, for the purpose of cleaning the workpiece 4 and so the cleaning gas 84 will be delivered via the delivery line 66 to the output device 74 and blown onto the workpiece 4 with the aid of the nozzle unit 76 (cf. FIG. 3). As a result, impurities (which are not illustrated) will be dislodged from the surfaces and/or from the interior spaces of the workpiece 4.

Figure 4:
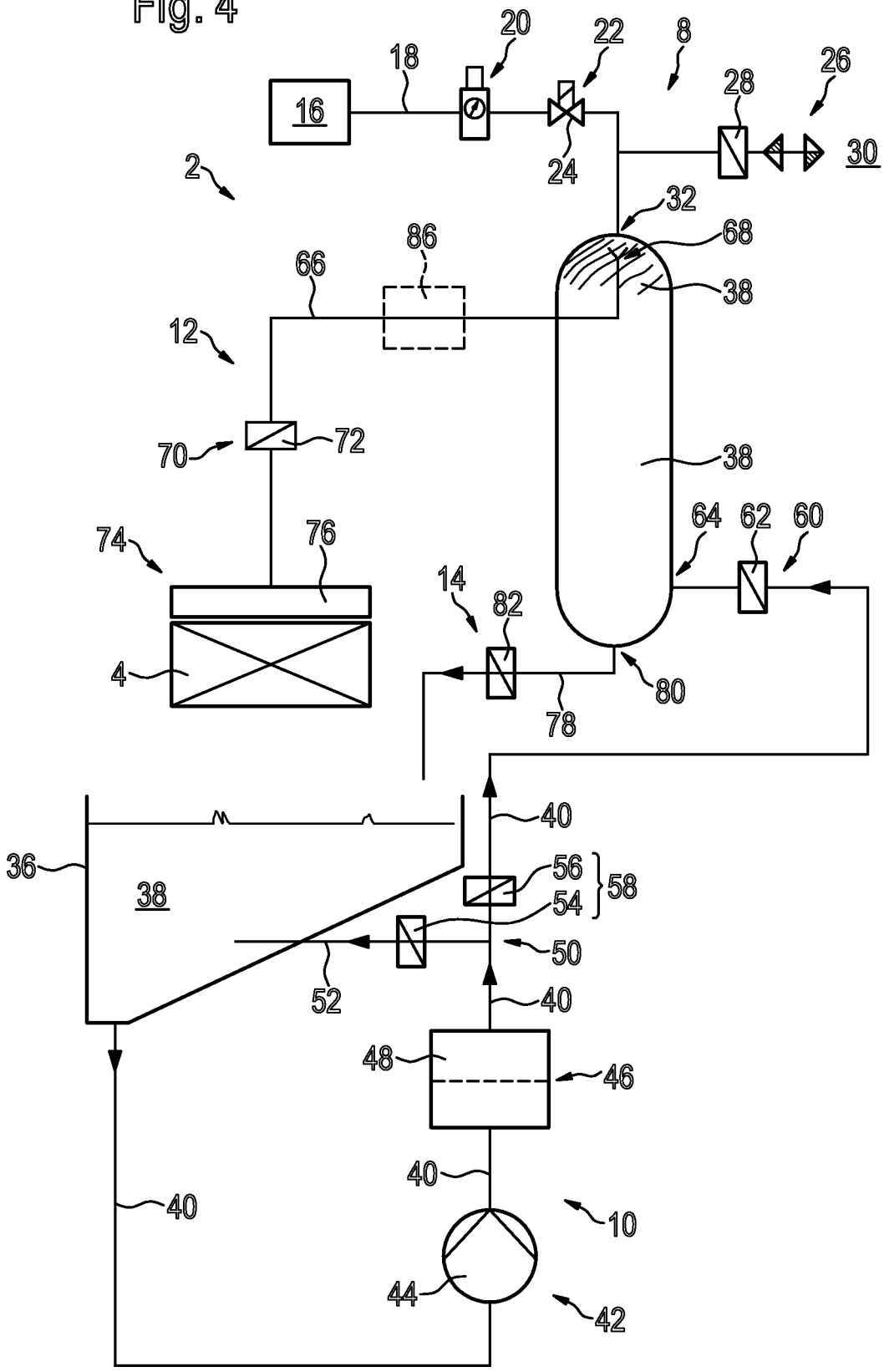
FIG. 4 shows the cleaning device according to FIG. 1 in a fourth phase of the cleaning process, in which cleaning liquid is delivered from the reservoir to the workpiece.

During the delivery of cleaning gas 84 from the reservoir 6 to the workpiece 4, it is advantageous when the supply device 10 for cleaning liquid continuously introduces cleaning liquid 38 into the reservoir 6. As a result, the cleaning gas 84 can be expelled completely from the reservoir 6 until this is completely filled with cleaning liquid 38 (FIG. 4). When the flow control valve 72 remains open, cleaning liquid 38 will, from this point of time on, be conveyed in the direction towards the workpiece 4 so that it can wash or spray from the workpiece or can flush out of the workpiece the impurities which were previously dislodged from the surfaces and/or from the interior spaces of the workpiece 4 with the aid of the cleaning gas.

In FIG. 4, a device 86 is indicated by broken lines which can be provided in a variation of the cleaning device 2 described as part of the delivery device 12, for example, along the delivery line 66 between the reservoir 6 and the flow control valve 72. The device 86 is designed as a pulse valve and serves the purpose of generating a pulsating volume flow of cleaning gas 84 and/or cleaning liquid 38. Such a device is described in WO 03/036144 A1 of the same applicant and reference is made herewith to its disclosure with respect to the construction and the functioning of such a device. The volume flow of the cleaning gas and/or of the cleaning liquid can be influenced with the aid of the device 86 during the delivery of cleaning gas 84 to the workpiece 4 (FIG. 3) and/or during the delivery of cleaning liquid 38 to the workpiece 4 (FIG. 4) such that the volume flow varies between smaller and greater volume flows. As a result, the cleaning effect of the cleaning device 2 can be increased further.

In order to bring the cleaning device 2 back into the basic position described with reference to FIG. 1 once the cleaning of the workpiece 4 has been finished, the shut-off valve 62 will be closed so that any further introduction of cleaning liquid 38 into the reservoir 6 is prevented. Furthermore, the second switch-over valve 56 will be closed and the first switch-over valve 54 opened so that the pump 44 conveys cleaning liquid 38 into the storage tank 36. Furthermore, the flow control valve 72 of the delivery device 12 will be closed in order to prevent any unintentional discharge of cleaning liquid 38 by the output device 74.

In order to empty the reservoir 6, the valve 82 will be opened so that cleaning liquid 38 is conveyed from the reservoir 6 via the outlet line 78 into the storage tank 36. In order to avoid any underpressure occurring in the upper area 68 of the reservoir 6, it is favorable to open the venting valve 28 during the emptying of the reservoir 6. The check valve 24 can remain closed. It is also possible, alternatively or in addition hereto, to open the check valve 24 in this phase in order to aid or to accelerate the emptying of the reservoir 6 and the draining of cleaning liquid 38 with the aid of the cleaning gas 84.

The invention claimed is:

1. Method for supplying a cleaning medium comprising a cleaning gas and a cleaning liquid, the method comprising:

introducing the cleaning gas into a reservoir, said cleaning gas being subject to an initial pressure;

taking the cleaning liquid from a storage tank and introducing the cleaning liquid subject to pressure into the reservoir for acting on the cleaning gas with pressure;

delivering the cleaning gas from the reservoir via a delivery line to an output device and blowing the cleaning gas onto a workpiece, wherein the delivery line extends from the reservoir to the output device;

delivering the cleaning liquid from the reservoir to the workpiece via the delivery line, wherein the cleaning gas and the cleaning liquid are conveyed to the workpiece from the reservoir one after the other;

conveying the cleaning liquid from the reservoir to the storage tank via an outlet line which is provided in addition to the delivery line and extends from the reservoir to the storage tank, said outlet line comprising a valve which can be opened and closed;

wherein the cleaning liquid is brought to an operating pressure exceeding the initial pressure of the cleaning gas prior to the cleaning liquid being introduced into the reservoir, and wherein the cleaning gas and the cleaning liquid are brought into direct contact with one another in the reservoir.

2. Method as defined in claim 1, wherein the cleaning gas is subject to the initial pressure prior to the cleaning liquid acting on the cleaning gas with pressure, said initial pressure being equal to ambient pressure.

3. Method as defined in claim 1, wherein the introduction of the cleaning gas into the reservoir is controlled by a blocking device, wherein the cleaning gas is supplied by a supply device for cleaning gas acting on the cleaning gas with a supply pressure for cleaning gas and wherein the blocking device is opened proceeding from a closed state until the cleaning gas introduced into the reservoir as a result is subject to an initial pressure equal to the supply pressure for cleaning gas and wherein the blocking device is subsequently closed.

4. Method as defined in claim 1, wherein the introduction of the cleaning gas into the reservoir is controlled by a blocking device, wherein the cleaning gas is supplied by a supply device for cleaning gas acting on the cleaning gas with a supply pressure for cleaning gas and wherein the blocking device is opened proceeding from a closed state only for such a time that the cleaning gas introduced into the reservoir as a result is subject to an initial pressure lower than the supply pressure for cleaning gas and wherein the blocking device is then closed.

5. Method as defined in claim 1, wherein the introduction of cleaning liquid into the reservoir is controlled by a shut-off device, wherein the cleaning liquid is supplied by a supply device for cleaning liquid acting on the cleaning liquid with a supply pressure for cleaning liquid and wherein the shut-off device is opened proceeding from a closed state until the cleaning liquid introduced into the reservoir as a result acts on the cleaning gas with the supply pressure of the cleaning liquid and wherein the shut-off device is subsequently closed.

6. Method as defined in claim 1, wherein the introduction of cleaning liquid into the reservoir is controlled by a shut-off device, wherein the cleaning liquid is supplied by a supply device for cleaning liquid acting on the cleaning liquid with a supply pressure for cleaning liquid and wherein the shut-off device is opened proceeding from a closed state only for such a time that the cleaning liquid introduced into the reservoir as a result acts on the cleaning gas with an operating pressure lower than the supply pressure of the cleaning liquid and wherein the shut-off device is then closed.

7. Method as defined in claim 1, wherein cleaning liquid is taken from a storage tank and cleaning liquid subject to the supply pressure for cleaning liquid is returned to the storage tank.

8. Method, comprising:

cleaning a workpiece using the method as defined in claim 1.

9. Method as defined in claim 8, wherein the cleaning liquid is brought to an operating pressure exceeding the initial pressure of the cleaning gas prior to the cleaning liquid being introduced into the reservoir.

10. Method as defined in claim 8, wherein the cleaning gas is conveyed first of all from the reservoir to the workpiece and then the cleaning liquid and wherein cleaning liquid subject to pressure is introduced into the reservoir during the delivery of cleaning gas and/or cleaning liquid from the reservoir to the workpiece.

11. Method as defined in claim 1, wherein the cleaning gas is air.

12. Method as defined in claim 1, wherein cleaning liquid is continuously introduced into the reservoir during the delivering of the cleaning gas from the reservoir to the workpiece.

13. Use of a cleaning device for cleaning a workpiece, with a reservoir for storing a cleaning medium and with a delivery device for the delivery of the cleaning medium from the reservoir to the workpiece, wherein the reservoir is connected to a supply device for cleaning gas for introducing a cleaning gas into the reservoir and wherein for the purpose of acting on the cleaning gas with pressure the reservoir is connected to a supply device for cleaning liquid for introducing cleaning liquid subject to pressure into the reservoir, wherein the supply device for cleaning liquid comprises a device for applying pressure for acting on the cleaning liquid with pressure, for carrying out a method comprising:

introducing the cleaning gas into the reservoir;

taking the cleaning liquid from a storage tank and introducing the cleaning liquid subject to pressure into the reservoir for acting on the cleaning gas with pressure, said cleaning gas being subject to an initial pressure;

delivering the cleaning gas from the reservoir via a delivery line to an output device and blowing the cleaning gas onto a workpiece, wherein the delivery line extends from the reservoir to the output device;

delivering the cleaning liquid from the reservoir to the workpiece via the delivery line, wherein the cleaning gas and the cleaning liquid are conveyed to the workpiece from the reservoir one after the other;

conveying the cleaning liquid from the reservoir to the storage tank via an outlet line which is provided in addition to the delivery line and extends from the reservoir to the storage tank, said outlet line comprising a valve which can be opened and closed;

wherein the cleaning liquid is brought to an operating pressure exceeding the initial pressure of the cleaning gas prior to the cleaning liquid being introduced into the reservoir, and wherein the cleaning gas and the cleaning liquid are brought into direct contact with one another in the reservoir.

* * * * *